US010176735B2

(12) United States Patent
Nguyen et al.

(10) Patent No.: US 10,176,735 B2
(45) Date of Patent: Jan. 8, 2019

(54) PACKAGED MEDICATION ASSEMBLY AND ASSOCIATED METHOD

(71) Applicant: CVS Pharmacy, Inc., Woonsocket, RI (US)

(72) Inventors: Liem T. Nguyen, Sugar Land, TX (US); Nicole J. Krsnak, Minneapolis, MN (US)

(73) Assignee: CVS PHARMACY, INC., Woonsocket, RI (US)

( * ) Notice: Subject to any disclaimer, the term of this patent is extended or adjusted under 35 U.S.C. 154(b) by 94 days.

(21) Appl. No.: 14/070,104

(22) Filed: Nov. 1, 2013

(65) Prior Publication Data

US 2014/0151250 A1 Jun. 5, 2014

Related U.S. Application Data

(60) Provisional application No. 61/732,038, filed on Nov. 30, 2012.

(51) Int. Cl.
*B65D 77/24* (2006.01)
*G09F 23/10* (2006.01)
(Continued)

(52) U.S. Cl.
CPC ..... *G09F 23/10* (2013.01); *A61G 2205/30* (2013.01); *A61J 1/03* (2013.01); *A61J 1/16* (2013.01)

(58) Field of Classification Search
CPC . A61J 1/03; A61J 2205/30; A61J 1/16; B65D 31/00; B65D 31/005
(Continued)

(56) References Cited

U.S. PATENT DOCUMENTS 224,934 A * 2/1880 McCullough ..... B65D 31/005 383/122
3,625,547 A * 12/1971 Burke ..... B42D 5/02 283/81
(Continued)

FOREIGN PATENT DOCUMENTS

JP 2000219246 A 8/2000
JP 2001190640 A 7/2001
(Continued)

OTHER PUBLICATIONS

Office Action from Canadian Patent Application No. 2,833,482, dated Feb. 18, 2014 (2 pages).

*Primary Examiner* — Robert Poon
(74) *Attorney, Agent, or Firm* — Patent Law Works LLP

(57) ABSTRACT

A packaged medication assembly includes a packaged medication, a bag, and an information insert. The packaged medication includes a container and medication enclosed within the container. The bag defines a first panel, a storage chamber, and an opening to the storage chamber. The information insert includes patient information, which provides identification of a patient that the medication was packaged for, and medication information providing at least one of an identity of and a description of the medication. The information insert includes a patient identifying section including the patient information adjacent the first edge. The information insert is placed in the storage chamber such that substantially only the patient identifying section extends and remains exposed above the first panel such that a remainder of the information insert is covered by the first panel of the bag. The packaged medication is positioned within the storage chamber.

16 Claims, 13 Drawing Sheets

(51) Int. Cl.
*A61J 1/03* (2006.01)
*A61J 1/16* (2006.01)

(58) Field of Classification Search
USPC ..... 206/232, 534, 540, 459.5; 40/124.06, 40/641, 642.02, 360, 312
See application file for complete search history.

(56) References Cited

U.S. PATENT DOCUMENTS 4,185,405 A 1/1980 Giulie
4,189,053 A 2/1980 Stagnitto et al.
4,365,629 A * 12/1982 Pert et al. ..... 604/408
4,799,712 A 1/1989 Biava et al.
4,811,845 A 3/1989 Baggett
4,860,899 A 8/1989 McKee
4,889,237 A * 12/1989 Brandon ..... A61J 7/04 206/534
5,169,001 A * 12/1992 Scheibel ..... A61J 1/035 206/425
5,328,208 A * 7/1994 Garrison ..... 283/105
5,468,110 A 11/1995 McDonald et al.
5,603,409 A 2/1997 Braverman
5,631,068 A 5/1997 Smith
5,642,906 A * 7/1997 Foote et al. ..... 283/67
5,803,499 A * 9/1998 Tung ..... B42D 15/00 283/56
5,813,539 A * 9/1998 DePalma ..... G09D 3/04 206/459.1
5,931,304 A * 8/1999 Hammond ..... A61F 17/00 206/425
6,167,679 B1 * 1/2001 Horton-Steidle et al. ..... 53/411
6,375,225 B1 4/2002 Lapsker
6,460,702 B2 10/2002 Hammond
6,564,945 B1 * 5/2003 Weinstein ..... A61J 1/03 206/459.5
6,752,272 B2 6/2004 Jones et al.
7,225,052 B2 5/2007 Foote et al.
7,311,205 B2 12/2007 Adler et al.
7,413,082 B2 8/2008 Adler et al.
7,628,427 B2 12/2009 Adler et al.
7,661,533 B2 2/2010 Adler et al.
7,942,451 B2 5/2011 Adler
7,980,391 B2 7/2011 Adler et al.
8,025,314 B2 9/2011 Adler
8,056,712 B2 11/2011 Igawa et al.
8,151,835 B2 4/2012 Khan et al.
8,475,901 B2 7/2013 Viavattine et al.
8,752,704 B2 * 6/2014 Leon Alonso ..... A61J 1/035 206/531
2004/0193454 A1 9/2004 Foote et al.
2007/0029788 A1 * 2/2007 Adler ..... A61J 7/04 283/81
2007/0193899 A1 * 8/2007 Weber ..... G11B 33/0422 206/308.1
2007/0267319 A1 11/2007 Farley et al.
2008/0017602 A1 1/2008 Adler et al.
2008/0100054 A1 5/2008 Richards
2010/0145798 A1 6/2010 Richards
2010/0326865 A1 * 12/2010 Maistrellis ..... B42F 21/00 206/459.5
2011/0064339 A1 * 3/2011 Chertkow ..... 383/211
2012/0061283 A1 * 3/2012 Behman ..... B65D 33/004 206/534
2012/0097560 A1 * 4/2012 Contractor ..... A61J 1/035 206/232
2012/0296308 A1 11/2012 Bianco et al.
2013/0097973 A1 4/2013 McCoy et al.
2013/0102989 A1 4/2013 McCoy et al.

FOREIGN PATENT DOCUMENTS

JP 2003034335 A 2/2003
JP 2003135564 A 5/2003
JP 2009178343 A 8/2009

* cited by examiner 14 130 132

NDC: 43292-0556-31 | Any Town, MN 54321 | Refills: 1 Thru 12/31/12 | NCPDP: 3335230
ALERTAB 25 MG | (612)555-5678 | Rx NPI: 1679595227 | Amt. Due: $10.00

104 108

ALERTAB 25MG

*Patient Education* Retail Value: $5.99 Amt. Due: $10.00

*John Doe* NEW

Description:

106

Medication: ALERTAB 25MG
Date: 03/22/12
Prescription: 0000-8000-4640
Directions: Take one tablet by mouth once daily

134

*Read this medicine information sheet carefully each time you get this medicine filled.*

136

Diphenhydramine Capsules and Tablets
Pronunciation: DYE-fen-HYE-dra-meen
Brand Name: Examples include Banophen and Benadryl Allergy Ultratabs

This medicine is used for:

Preventing or treating symptoms of hay fever and other upper respiratory allergies or the common cold, such as runny nose, sneezing, itching of the nose and throat, and itchy, watery eyes, and relieving cough. It may also relieve itching of the skin and allergic skin reactions. It is also used to treat and prevent motion sickness. It may also be used for the conditions as determined by your doctor.

This medicine is an antihistamine and anticholinergic. It works by blocking the action of histamine, reducing the symptoms of an allergic reaction. It also works in the brain to cause sedation.

Do NOT use this medicine if:

* you are allergic to any ingredient in this medicine or to other similar medicines
* you are taking sodium oxybate (GHB)
* you are breast-feeding Contact your doctor of health provider right away if any of these apply to you.

Before using this medicine:

Some medical conditions may interact with this medicine. Tell your doctor or pharmacist if you have any medical conditions, especially if any of the

FIG. 9

PACKAGED MEDICATION ASSEMBLY AND ASSOCIATED METHOD

CROSS-REFERENCE TO RELATED APPLICATION

This application is a non-provisional application claiming priority under 35 U.S.C. 119 to U.S. Provisional Patent Application No. 61/732,038, filed Nov. 30, 2012, which is incorporated herein by reference.

BACKGROUND OF THE INVENTION

Virtually everyone consumes prescription pharmaceuticals at one time or another. In each instance, the consumer is faced with a series of procedural steps and information. The procedural steps include submitting the prescription, waiting for it, picking up the prescription, and signing applicable notices. A large volume of information about the patient, pharmacy, physician, and drug is provided on the prescription sticker on the bottle and on pharmacy transactional papers (e.g., on one or more printed, folded sheets) included with the prescription. In many instances, where prescriptions are filled for subsequent patient pick up, the filled prescriptions are placed in pharmacy bags with descriptive and other information being attached to an external surface of the bag via an adhesive label or one or more staples. Such systems aim to position patient identifying information to aid identification by a pharmacy employee when a patient arrives to pick up the previously filled prescription.

While these conventional methods provide for relatively quick identification, securement of papers or labels to the external surface or the bag increases steps and the required to complete filling and packaging of a prescription and may present a haphazard overall presentation. In addition, the external identifying papers may become separated from the bag, thereby, presenting additional identification issues. As such, other methods of packaging and identifying prescriptions for subsequent patent pick-up are desired.

SUMMARY

One embodiment of the invention relates to a packaged medication assembly including a packaged medication, a bag, and an information insert. The packaged medication includes a container and medication enclosed within the container. The bag defines a bottom bag fold line, a first panel adjacent the bottom bag fold line, a storage chamber, and an opening to the storage chamber formed at least partially by a first edge of the first panel opposite the bottom bag fold line. The information insert has a width smaller than and a height greater than a width and a height of the first panel of the bag. The height of the information insert is defined between the first edge and a second edge of the information insert. The information insert includes patient information, which provides identification of a patient that the medication was packaged for, and medication information providing at least one of an identity of and a description of the medication. The information insert includes a patient identifying section including the patient information adjacent the first edge. The information insert is placed in the storage chamber such that the second edge is positioned adjacent the bottom bag fold line and substantially only the patient identifying section extends and remains exposed above the first edge of the first panel such that a remainder of the information insert is covered by the first panel of the bag. The packaged medication is positioned within the storage chamber. Other packaged medication assemblies, associated combinations, and associated methods are also disclosed.

BRIEF DESCRIPTION OF THE DRAWINGS

Embodiments of the invention will be described with respect to the figures, in which like reference numerals denote like elements, and in which:

FIG. 9 is a front view illustration of a printed prescription information section of the sheet blank of FIGS. 6 and 7, according to one embodiment of the invention.

DETAILED DESCRIPTION

Figure 1:
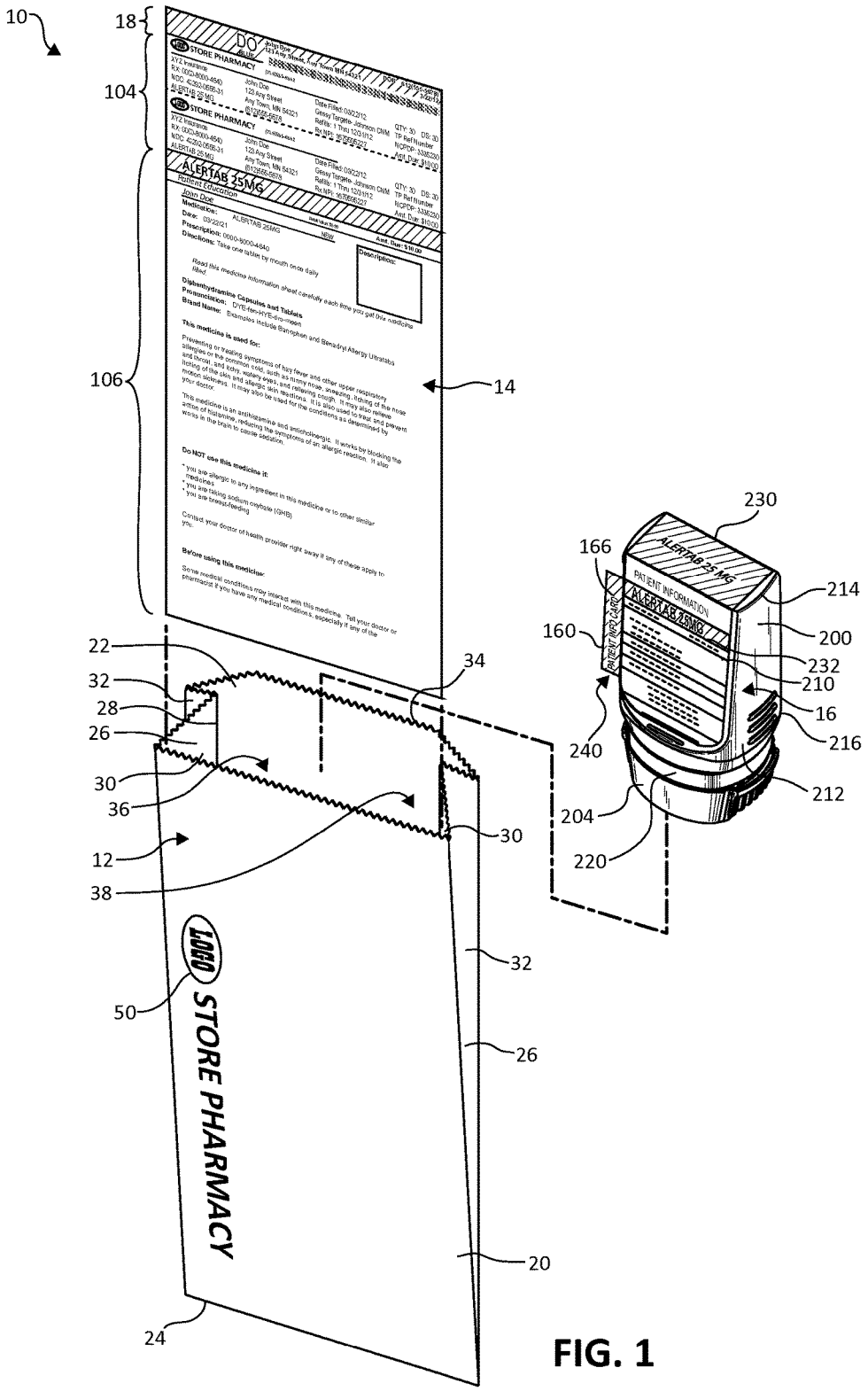
FIG. 1 is an exploded, perspective view illustration of a packaged medication assembly, according to one embodiment of the invention.
Figure 2:
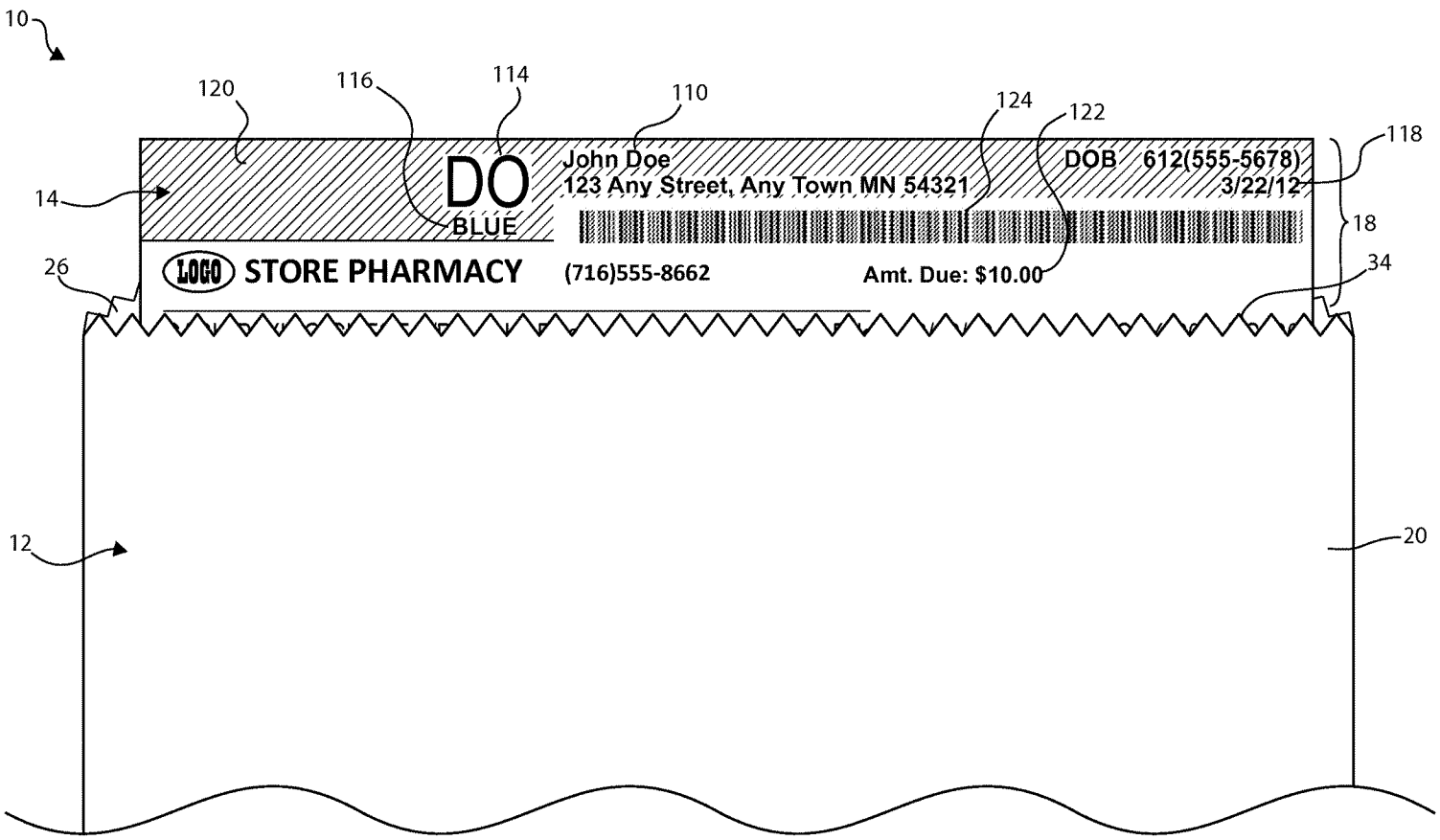
FIG. 2 is a partial front view illustration of an assembled packaged medication assembly of FIG. 1, according to one embodiment of the invention.
Figure 3:
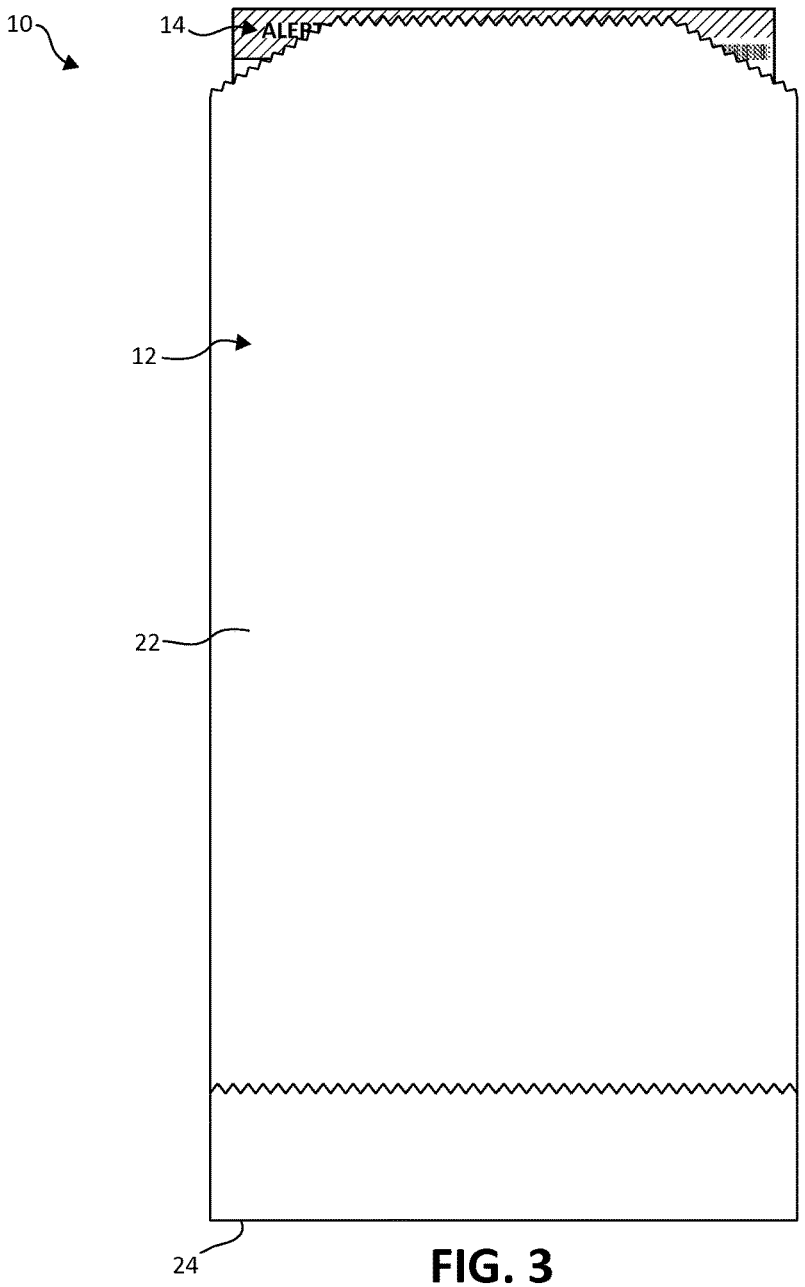
FIG. 3 is a rear view illustration of the packaged medication assembly of FIG. 2, according to one embodiment of the invention.
Figure 4:
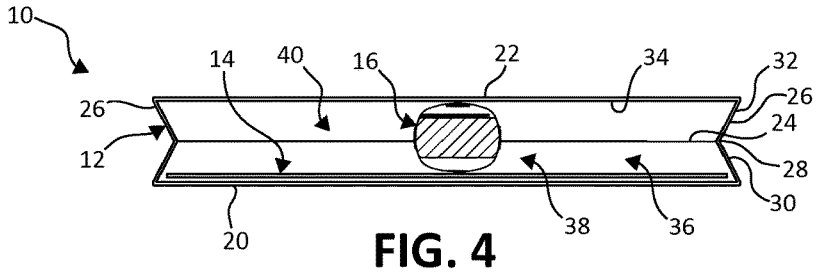
FIG. 4 is a top view illustration of the packaged medication assembly of FIG. 2, according to one embodiment of the invention.

In the following detailed description, reference is made to the accompanying drawings, which form a part hereof, and in which is shown by way of illustration specific embodiments in which the invention may be practiced. The following detailed description, therefore, is not to be taken in a limiting sense, and the scope of the present invention is defined by the appended claims.

Embodiments of the invention are directed to a prescription or medication packaging system that significantly enhances the efficiency in which a prescription or drug order can be filled and prepared for future pick-up by a patient while also enhancing identification of pre-filed prescriptions and drug orders at the time of their pick up. These improvements also lead to an improved consumer experience in having a prescription filled at a pharmacy. In one example, the system includes a bag or other external container, an information sheet, and a filled prescription or other drug. The bag includes a lower edge and an open top. The information sheet is sized to a width slightly smaller than an inside width of the bag and a height greater than a height of the bag, at least greater than a height of a front panel of the bag.

Per the above, the information sheet is sized to fit within the bag such that a top portion of the information sheet extends above a top of the bag or at least a top of the front panel of the bag. The information sheet includes details about the patient, the prescription or other medication, etc. More particularly, the portion of the information sheet that extends above the bag includes information identifying the patient, but, in one embodiment, not identifying details about the prescription or other medication specifics. By maintaining such information substantially hidden within the bag, the privacy of the patient is respected and details of their health, etc. are not exposed for ready viewing by other customers, etc. These embodiments and other embodiments of the invention are described in greater detail below in association with FIGS. 1-16.

As shown in FIGS. 1-4, in one embodiment, a packaged medication assembly 10 comprises an external container such as a sleeve or a bag 12, an information insert 14, and a packaged medication 16 (otherwise referred to herein as a pharmaceutical item), such as a pre-filed prescription. When a prescription is filled or other packaged medication 16 prepared, information insert 14 is printed and placed in bag 12 along with packaged medication 16. Information insert 14 generally sits in bag 12 in front of packaged medication 16 and a patient identifying section 18 at the top of information insert 14 extends beyond a top, front edge of bag 12 to present information relating to the patient allowing for quick identification of the particular bag 12 from a plurality of similarly prepared bags 12 (see FIG. 5) for all pharmacy customers (i.e., other patients) when that patient or their designee arrives at the pharmacy to retrieve the packaged medication 16.

Figure 5:
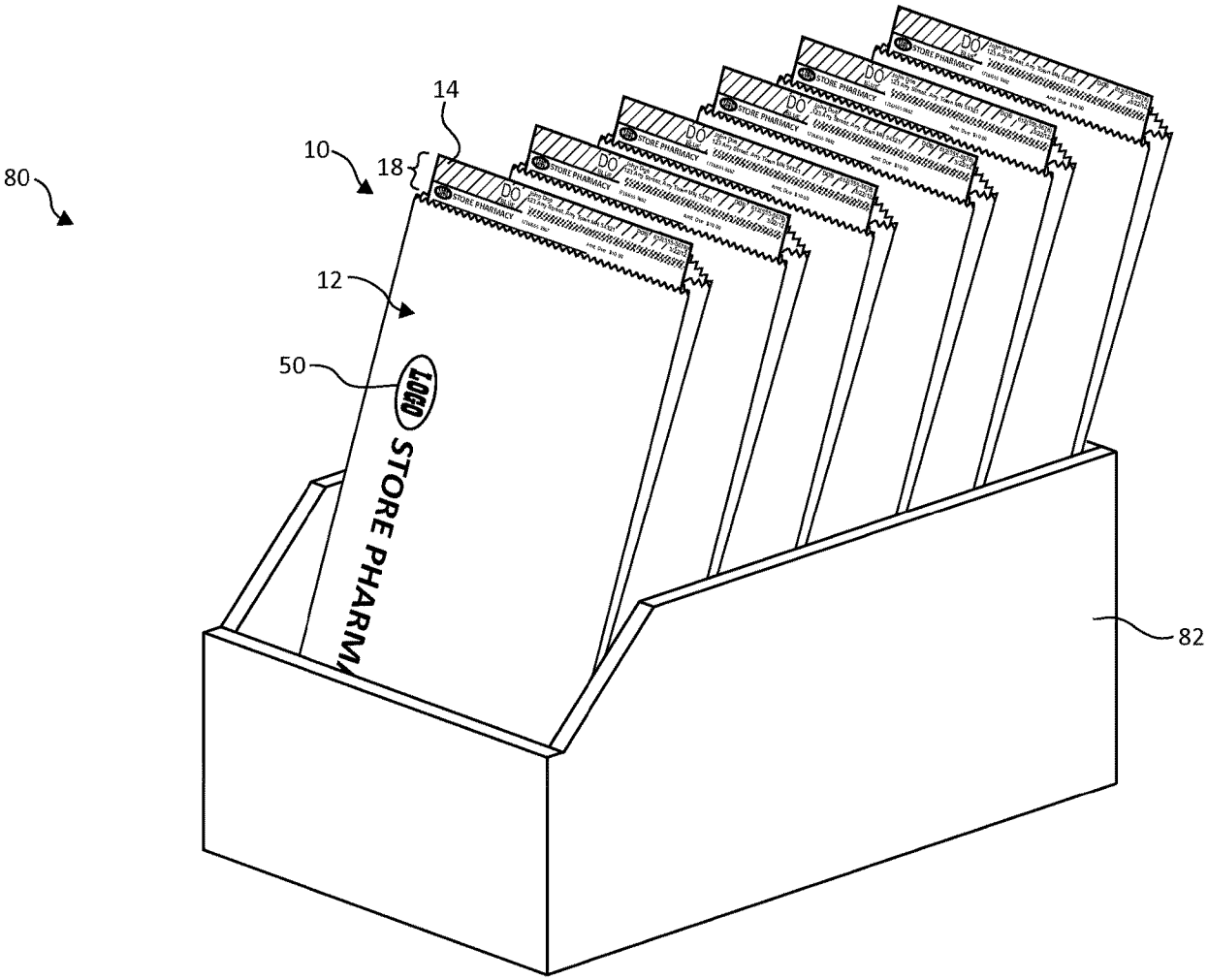
FIG. 5 is a front perspective view illustration of a pharmacy system including a bin maintaining a plurality of packaged medication assemblies, according to one embodiment of the invention.

For example, similarly prepared bags 12 are placed in a substantially horizontal stack (e.g., a horizontal array) in a bin 82 or other container as part of a pharmacy fulfillment system 80 as shown in FIG. 5. In this arrangement, patient identifying section 18 extends upwardly above tops of bags 12 allowing ready identification of a desired one of the packaged medication assembly 10 without requiring the pharmacy employee to flip through individual ones of the packaged medication assemblies 10 in the array to find the desired one.

More particularly, in one embodiment, bag 12 is a plastic, paper, or otherwise suitably formed bag including a front panel 20, a rear panel 22 intersecting along a bottom bag fold line 24. Front panel 20 and rear panel 22 are, therefore, positioned opposite one another. In one embodiment, front panel 20 has a height (i.e., extends a distance from bottom bag fold line 24) less than a height of rear panel 22 (i.e., distance rear panel 22 extends from bottom bag fold line 24).

A side panel 26 is formed on either side of bag 12 to extend between front panel 20 and rear panel 22. In one example, each side panel 26 includes a center longitudinal fold line 28 extending from bottom bag fold line 24 to a top the respective side panel 26 to define a front side panel section 30 adjacent front panel 20 and a rear side panel section 32 adjacent rear panel 22. Bag 12 folds substantially flat when longitudinal fold line 28 is moved into bag 12 (i.e., toward opposite side panel 26) such that front side panel section 30 is folded over, fully contacts, and extends substantially coextensively with rear side panel section 32. A storage chamber 36 is formed between front panel 20, rear panel 22, and side panels 26. Storage chamber 36 includes a front storage section 38, which extends forwardly from each longitudinal fold line 28 to front panel 20, and a rear storage section 40, which extends rearwardly from each longitudinal fold line 28 to rear panel 22.

Figure 6:
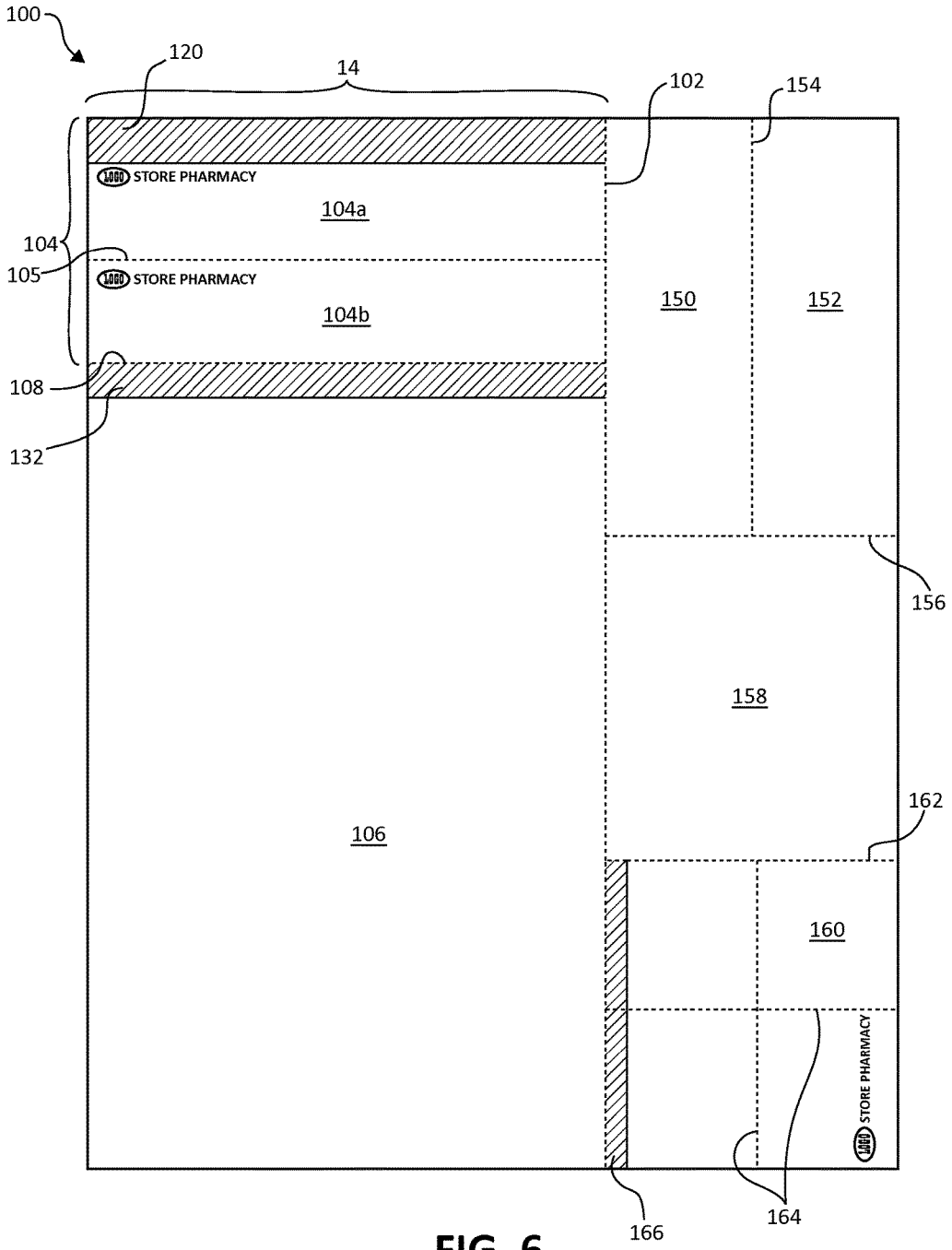
FIG. 6 is a front view illustration of a sheet blank, according to one embodiment of the invention.

Information insert 14 is printed while filling a consumer's prescription, according to one embodiment of the invention. Referring also to the front surface view of FIG. 6 and the rear surface view of FIG. 7, in one embodiment, a plurality of prescription information sheets 100 are initially provided to the pharmacy in a blank form, e.g., as illustrated in FIG. 6, with very little, if any, text (e.g., shown in FIG. 1) included, but with various portions, including information insert 14, defined by at least perforations or other lines of indication. As such, a pharmacist or other pharmacy employee is able to feed the plurality of prescription information sheets 100 into a printer programmed or coupled with a processor configured to instruct the printer to print the proper text, etc. to predefined portions of individual ones of the plurality of prescription information sheets 100 to produce the resultant information insert 14 for individual prescriptions and other items as shown, for example, in FIGS. 6-14. In one embodiment, each information sheet 100 defines various colored or shaded areas generally indicated with diagonal shading, perforations, or otherwise defined areas consistent with various features of the innovation described herein.

Figure 7:
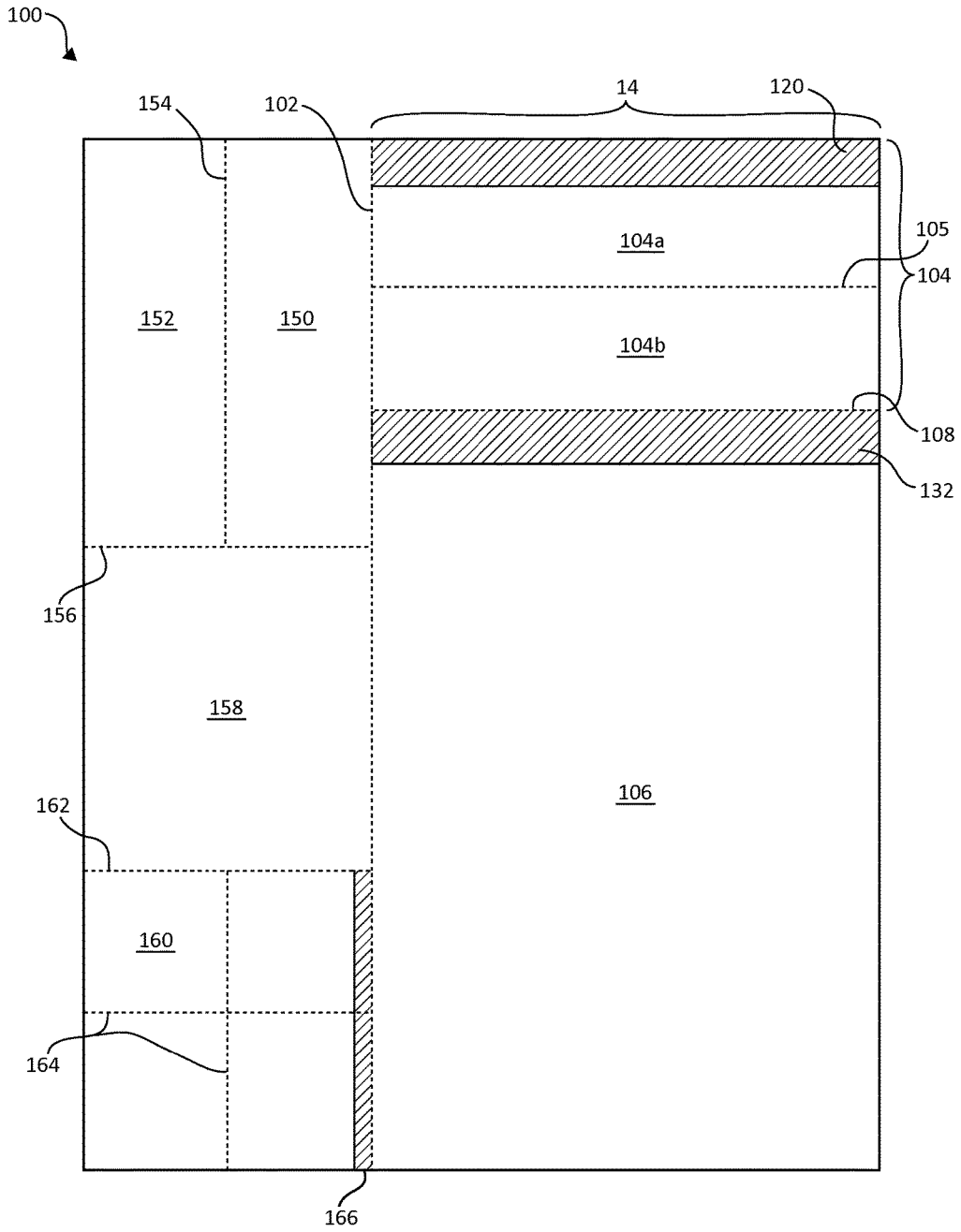
FIG. 7 is a rear view illustration of a sheet blank, according to one embodiment of the invention.

In one embodiment, prescription information sheet 100 is configured to be divided into many pieces configured for use in filling a prescription to meet statutory and other regulations, to inform the consumer, to facilitate filling and prescription tracking, etc. Such pieces may be positioned in any suitable arrangement to fit special and content needs, etc. For example, as illustrated, one side of prescription information sheet 100 defines one or more of guest receipt section 104, drug information section 106, a pharmacy processing section 150, compliance section 152, blank section 158, and an information card 160 each separated by perforation lines 102, 108, 154, 156, 162, and 164 to be easily separated from one another and used for their desired purpose. Perforation lines 102, 108, 154, 156, 162, and 164 are preformed in the blank versions of prescription information sheets 100 as shown in FIGS. 6 and 7.

More specifically, in one embodiment, prescription information sheet 100 includes a longitudinal, hard perforation line 102 extending from a top edge to a bottom edge of prescription information sheet 100. As used herein, "hard perforation" refers to perforations configured to facilitate ready separation of adjacent sections of information sheet 100 from one another without the use of tools, while "soft perforation" refers to perforations configured to facilitate folding of adjacent sections of information sheet 100 that does not readily result in separation of those same adjacent sections unless additional separating force is applied. Up to an entirety of a portion of prescription information sheet 100 on one side of longitudinal, hard perforation line 102 defines information insert 14. In one example, information sheet 14 includes guest receipt section 104 and drug information section 106. Guest receipt section 104 may provide a single guest receipt or be divided into to more than one guest receipt, e.g., guest receipts 104*a* and 104*b* in FIGS. 6 and 7, via lateral perforation line 105. Each of guest receipts 104*a* and 104*b* provides information regarding an insurance company or lack thereof associated with the patient, prescription number, drug identification, patient name, patient address, patient phone, date the prescription was filled, refill information, quantity, amount due to be paid by the patient, etc. and provides the patient with records for use as they see fit, for example, as proof of purchase for insurance companies, as a record of prior prescriptions, etc.

Figure 8:
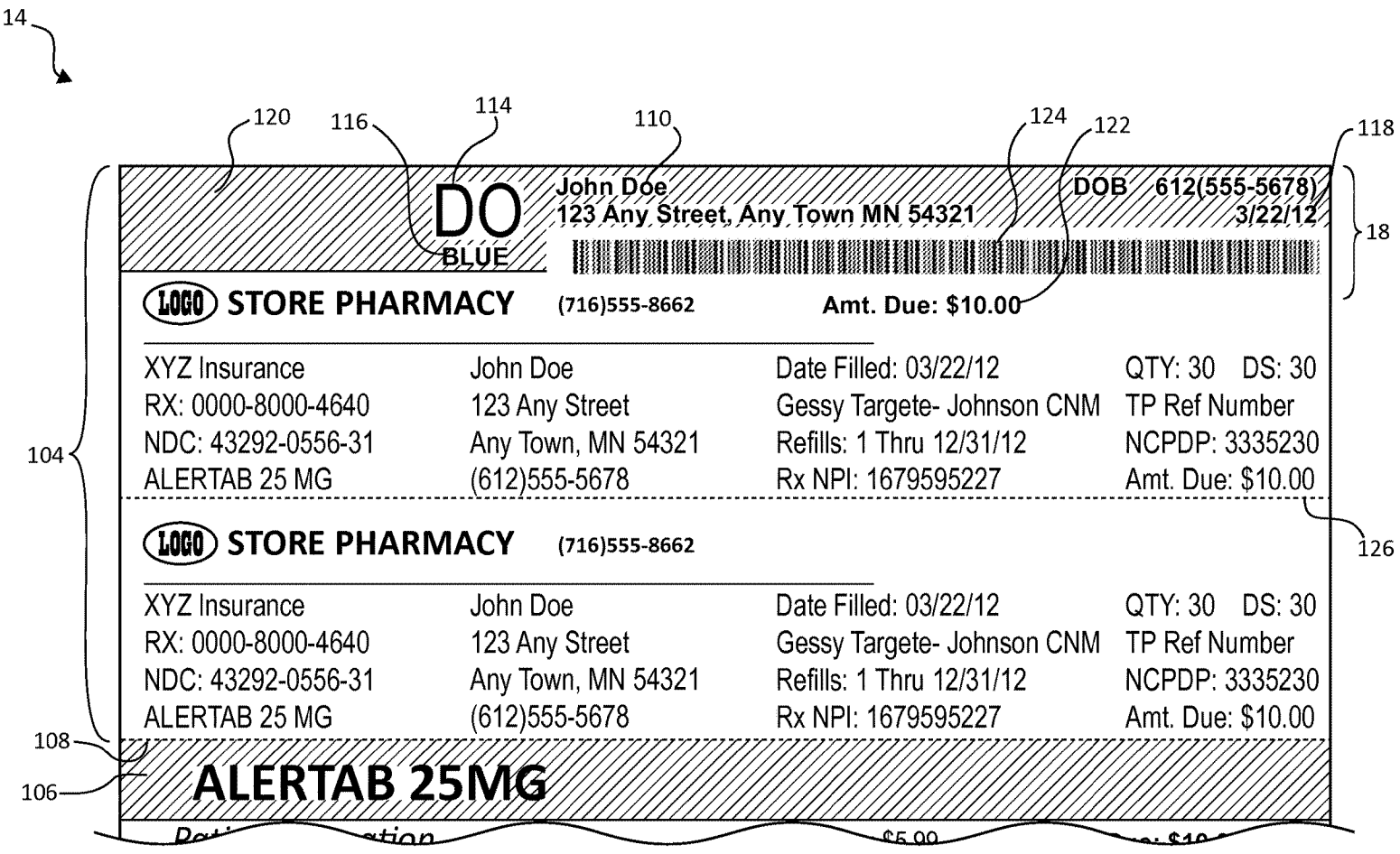
FIG. 8 is a front view illustration of a printed guest receipt section of the sheet blank of FIGS. 6 and 7, according to one embodiment of the invention.
Figure 10:
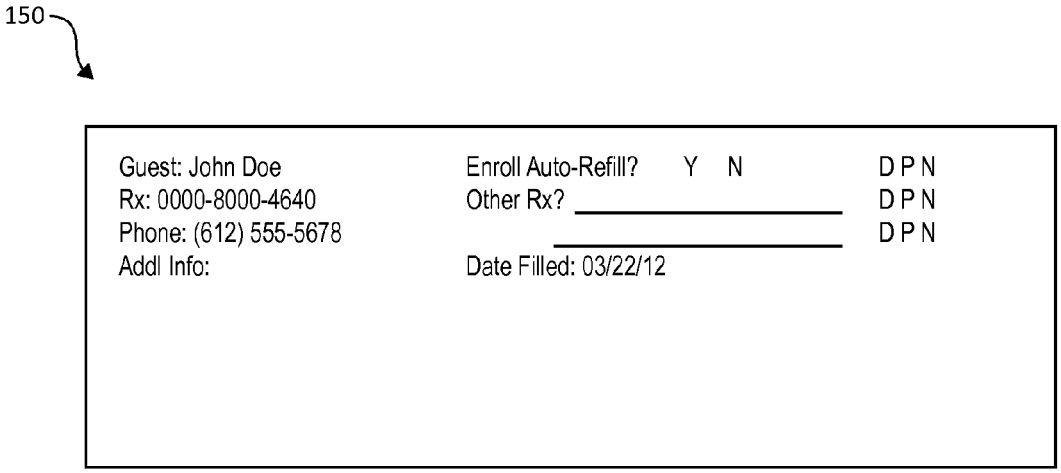
FIG. 10 is a front view illustration of a printed pharmacy use section of the sheet blank of FIGS. 6 and 7, according to one embodiment of the invention.
Figure 11:
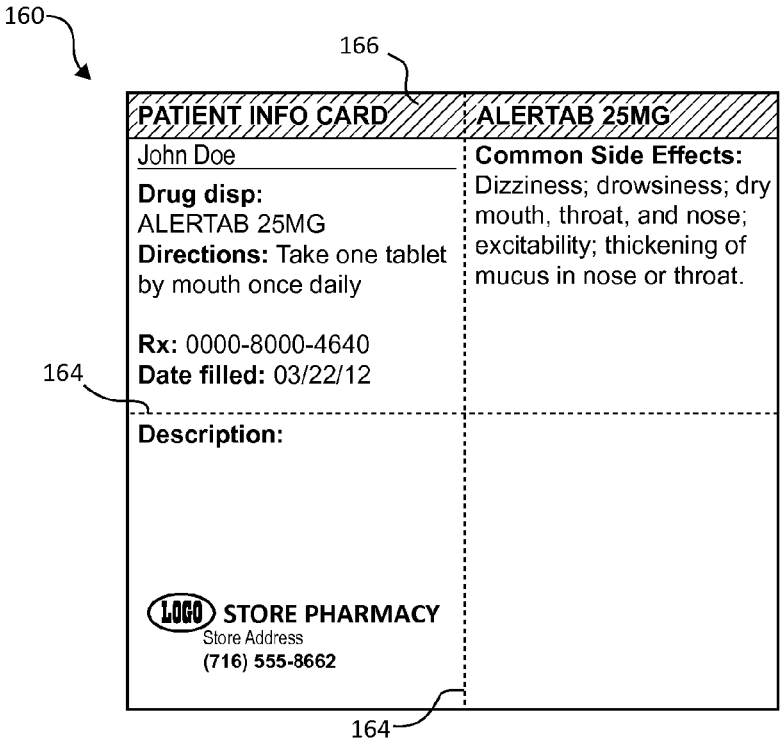
FIG. 11 is a front view illustration of a printed patient info card section of the sheet blank of FIGS. 6 and 7, according to one embodiment of the invention.

Additionally referring to FIG. 8, the top of guest receipt section 104, for example, the top of guest receipt 104*a*, and therefore the top of information insert 14 includes patient identifying section 18. Patient identifying section 18 includes patient information but is generally characterized by an absence of information identifying what prescription or other medication is contained in the corresponding bag 12 to maintain patient privacy during delivery of packaged medication assembly 10 to the patient or the designee of the patient. More particularly, in one embodiment, patient identifying section 18 includes a colored or shaded portion 120, which is preprinted to information sheets 100 prior to individual printing of the information sheets 100 at the pharmacy, to aid in easy identification of information subsequently printed thereon. As illustrated, information individually printed on each information sheet 100 as part of patient identifying section 18 includes the patient's name, address, phone number, and date of birth as generally indicated at 110 in the FIGS. 2 and 8.

Patient identifying section 18 includes an abbreviated partial patient identifier 114, for example, provided in a larger, bolder, or otherwise readily differentiated and, therefore, readily identifiable font as compared to other printing on guest receipt section 104. In one instance, abbreviated partial patient identifier 114 includes the first two letters in the last name of the patient. Other patient but non-prescription information may additionally be included at the top of information insert 14, such as a color code 116 associated with the patient to differentiate the patient from other family or household members as well as other patients having prescriptions filled at the same location as will be further described below.

Figure 12:
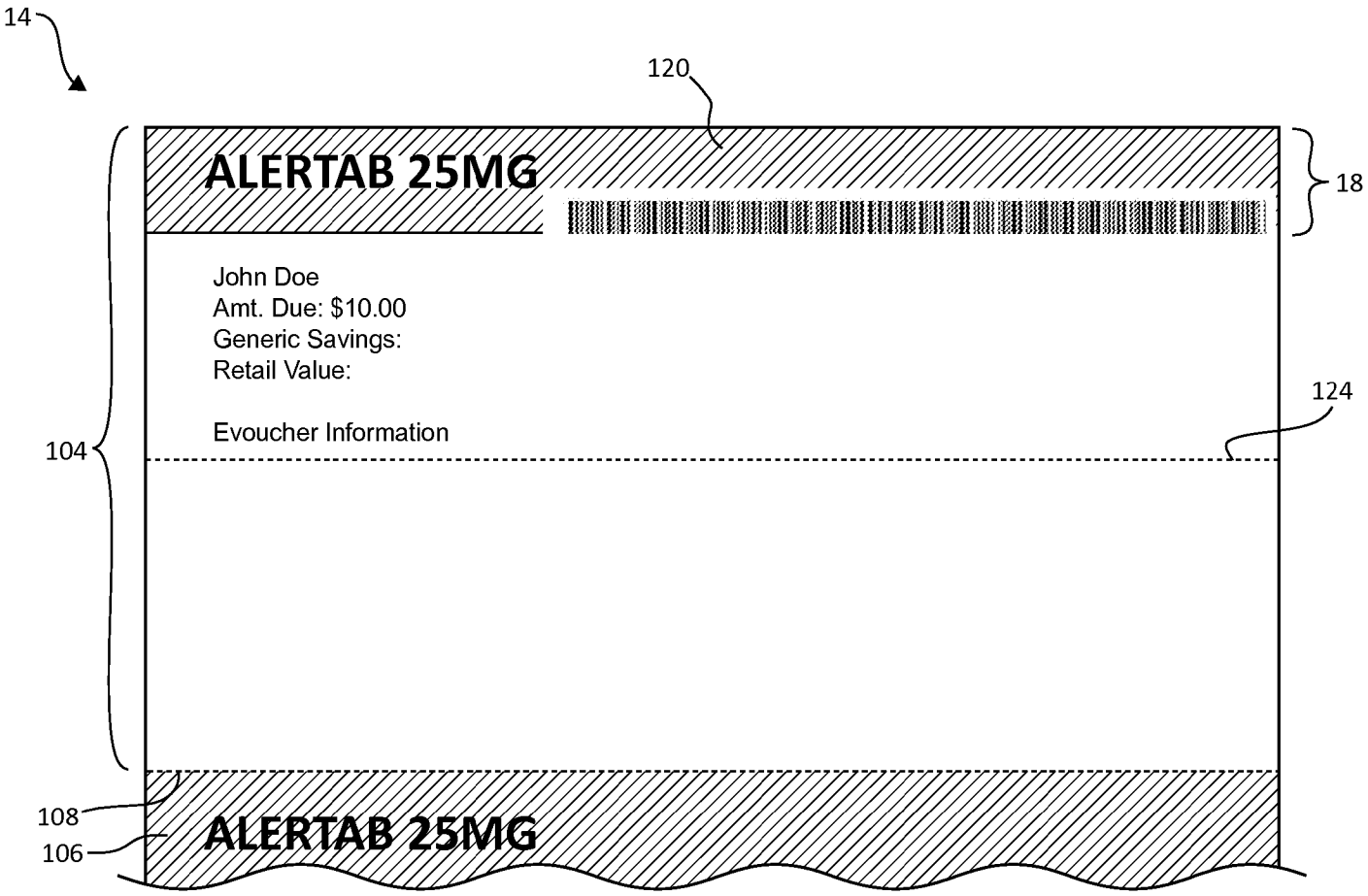
FIG. 12 is a rear view illustration of a printed guest receipt section of the sheet blank of FIGS. 6 and 7, according to one embodiment of the invention.

In one embodiment, other pharmacy usage data is also included as part of patient identifying section 18 such as a package or fill date 118 for the prescription or other medication. An amount due 122 by the patient at time of pick-up may also be printed to patient identifying section 18. In addition, a bar code 124 or other computer readable identifier configured to be read by a point-of-sale terminal to process associated prescription(s) or medication(s) for sale without requiring any other entry of drug, prescription, or similar information at the patient's transaction for purchase of the prescription or medication. Referring to FIG. 12, rear surface of information insert 14 also includes shaded portion 120 medicine and/or patient information. In one example, drug information is included on shaded portion 120 for easy identification by pharmacy workers, but in a manner substantially hidden by rear panel 22 of bag 12 upon assembly of information insert 14 with bag 12.

Figure 13:
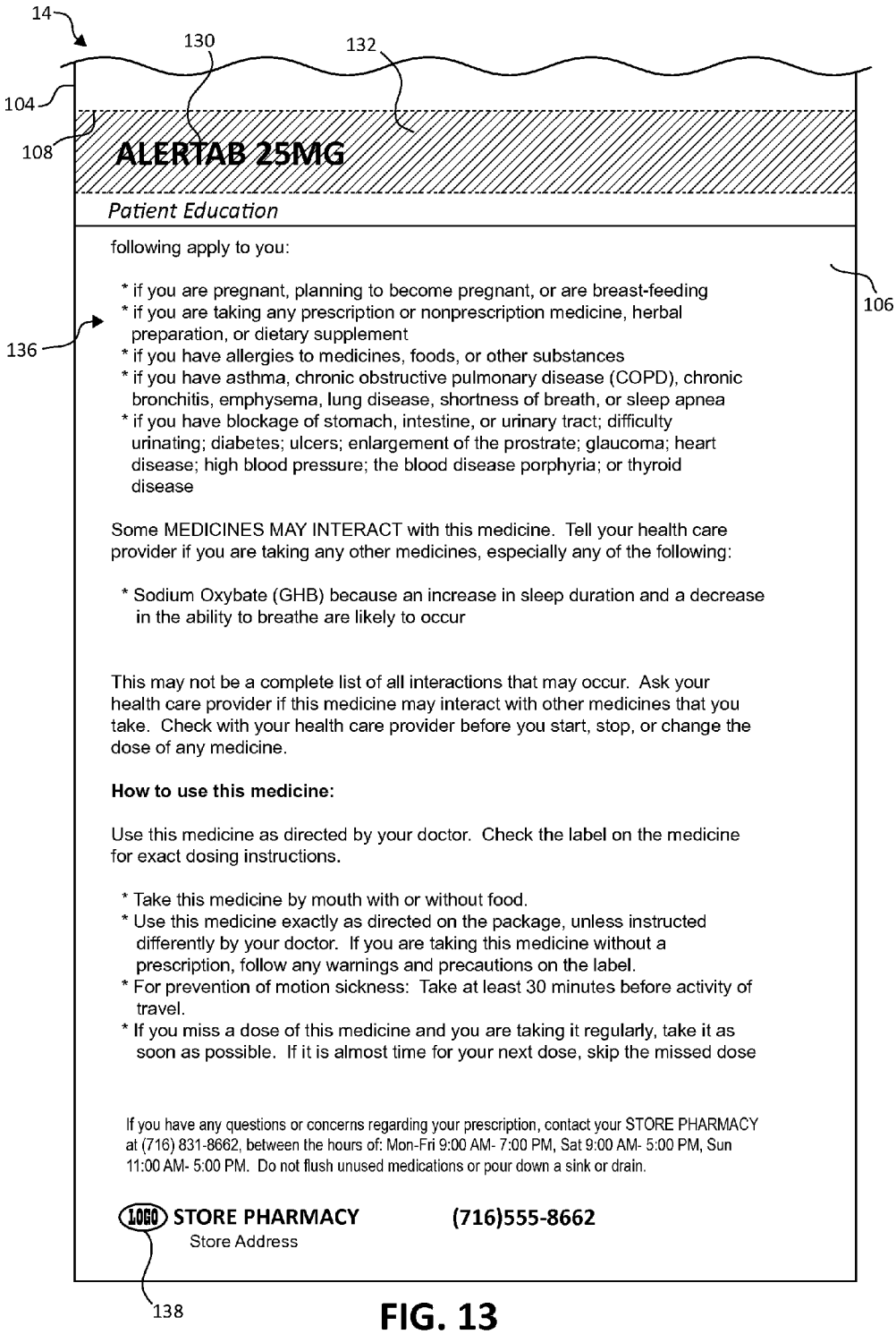
FIG. 13 is a rear view illustration of a printed prescription information section of the sheet blank of FIGS. 6 and 7, according to one embodiment of the invention.
Figure 14:
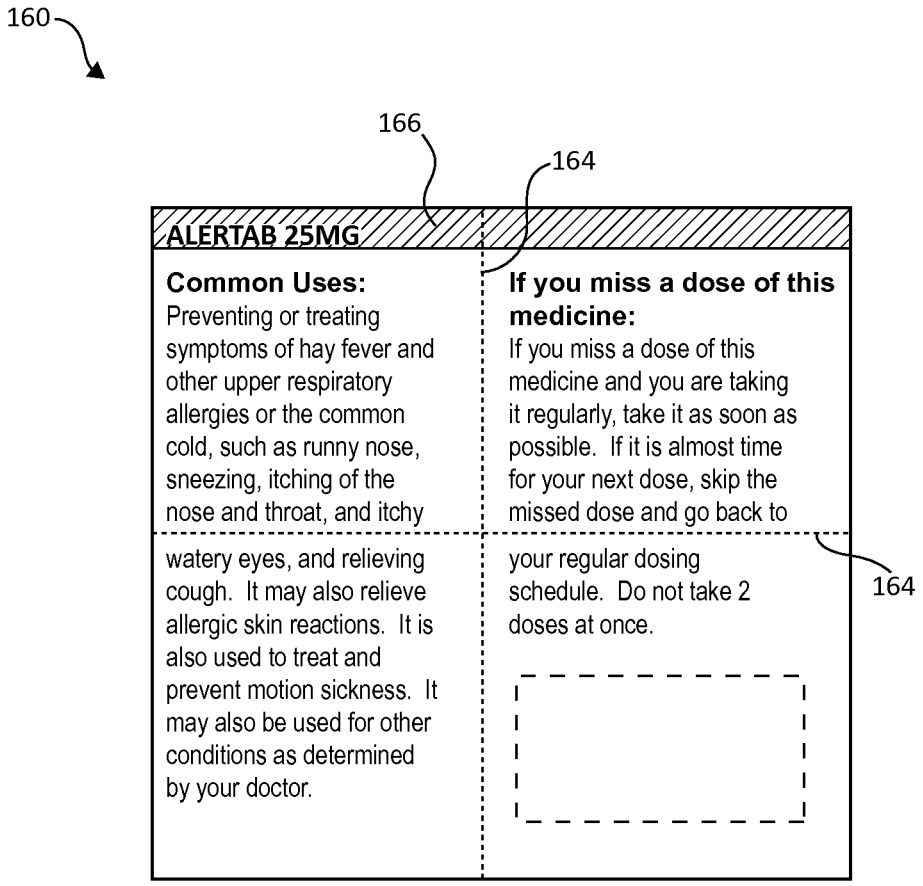
FIG. 14 is a rear view illustration of a printed pharmacy use section of the sheet blank of FIGS. 6 and 7, according to one embodiment of the invention.

Referring to the front views of FIGS. 6 and 9 and the rear views of FIGS. 7 and 13, drug information section 106 is separated from guest receipt section 104 by perforation line 108. In one embodiment, perforation line 108 is a soft perforation line. While guest receipt section 104 may be separated from drug information section 106 along perforation line 108 without tools, in one example, perforation line 108 is formed as a soft perforation line to decrease the likelihood that guest receipt section 104 would inadvertently be separated from drug information section 106 before a desired time by the end patient or their designee thereby maintaining the integrity of information insert 14 prior to deliver to the patient. Notably, perforation line 105 may be hard or soft depending upon desired use for guest receipts 104*a* and 104*b*. In one example, perforation line 105 is soft.

Drug information section 106 includes at least information about the medication that will be included in medicine package assembly 10 (see, e.g., FIG. 1) and/or information about the patient themselves and is intended to be an educational and/or reference document for the patient. In one example the information printed to drug information section 106 includes drug name identification 130 on preprinted color or shaded portion 132. More specific, drug information 136, e.g., details regarding the medication, use, possible side effects, dosage, etc., is provided on other portions of drug information section 106. In one embodiment, drug information section 106 of information insert 14 will be maintained substantially within chamber 16 of bag 12 behind front panel 20 of bag 12 such that information on drug information section 106 will be substantially concealed when information insert 14 is part of medicine package assembly 10. Accordingly, drug name identification 130 and/or drug information 136 can be included without the concern for patient privacy as considered for inclusion of information on patient identifying section 18 of guest receipt section 104, which is visible over a top of bag 12. In one example, drug name identification 130 and other text on drug information section 106 is printed in a font that is compliant with all federal or other associated regulations.

"Substantially hidden" as used herein refers to portions of information insert 14 that are entirely hidden and/or otherwise hidden that ones ability to read indicia on such portions is greatly hindered or obstructed making it very unlikely that a nearby patron other than the patient will be able to read indicia from such portion, e.g., drug name identification 130. For example, while when bag 12 is not overfilled, drug information section 106 is entirely hidden behind front panel 20 of bag 12, when bag 12 is overfilled, a portion of drug information section 106 may be partially visible, but will largely remain unreadable by nearby patrons other than the patient.

Referring again to FIGS. 6 and 7, the portion of information sheet 100 on an opposite side of longitudinal, hard perforation line 102 as compared to information insert 14 includes various sections such as pharmacy use section 150, compliance or notes section 152, blank section 158, and/or information card 160. Referring to 10, pharmacy use section 150 includes retail information relating to processing of the prescription and future prescriptions such as refill prescriptions. In one embodiment, pharmacy use section 150 is defined adjacent to longitudinal, hard perforation line 102 near a top edge of information sheet 100 and/or includes indicia indicating details regarding a refill, if applicable, including whether the consumer is enrolled in an associated automated refill program, an invitation to enroll in an associated automated refill program, any refills remain, and/or other notes that the pharmacy wishes to communicate to the consumer and/or the pharmacy employees.

Compliance or notes section 152 is, in the illustrated embodiment, positioned adjacent pharmacy use section 150 opposite longitudinal, hard perforation line 102 and, in one example, is separated from pharmacy use section 150 by a longitudinal, hard perforation line 154 extending downwardly from a top edge of information sheet 100 about one-third of the way toward a bottom or opposite edge thereof to intersect a horizontal hard perforation line 156 extending substantially parallel to the top edge of information sheet 100 from a side edge to longitudinal, hard perforation line 102. Compliance or notes section 152 may include state compliance information for the applicable state in which the prescription is being filled and/or may be left blank for notes, etc. Blank section 158 is defined adjacent horizontal hard perforation line 156 opposite pharmacy use section 150 and compliance or notes section.

Referring to FIGS. 6, 7, 11, and 14, information card 160 is defined adjacent longitudinal, hard perforation line 102 and a lateral hard perforation line 162, which is positioned adjacent blank section 158 and extends from longitudinal, hard perforation line 102 to a side edge of information sheet opposite information insert 14, according to one embodiment. In one example, upon assembly of medication package assembly 10 (FIGS. 1-5), information card 160 is maintained as part of packaged medication 16 as will be described in additional detail below. Information card 160 includes a colored or shaded portion 166 along one edge thereof and defines a longitudinal and a laterals soft perforation line 164 collectively dividing information card 160 in to four quadrants such that information card 160 is readily folded into a smaller overall dimension or footprint. According to one embodiment, information card 160 is printed with one or more of an additional drug identifier, directions for medication use, prescription number, medication side effects, medication common uses, missed dosage instructions, pharmacy information, etc. While described with a particular sections, perforation lines, information, etc., other variations to information sheet 100 will be apparent to those of skill in the art upon reading this application.

Returning to FIG. 1, packaged medication 16 can take any of a variety of forms as commonly presented in pharmacies including medication contained in boxes, droppers, bottles, blister packages, vials, plastic zipper close bags, stock bottles, etc. One example of packaged medication 16 is illustrated in FIG. 1 and includes a container such as a bottle 200, a label 230, and a cap 204 covering an opening to a storage compartment defined within bottle 200. Bottle 200 comprises a front portion 210, side portions 212, a spine portion 214, and a rear portion 216, an opening (not shown) opposite spine portion 214. Front portion 210 is positioned opposite rear portion 216, and one of side portions 212 extends between front portion 210 and rear portion 216 on either side of bottle 200 to define a storage chamber (not shown) therebetween maintain a prescription or other medication (not shown).

In one embodiment, each packaged medication 16 comprises a ring 220. Ring 220 encircles a portion of a neck (not shown) of bottle and, in one example, includes a color component for uniquely distinguishing between different bottles 200. In one embodiment, one color ring 220 represents a first type of medication while a second color ring 220 represents a second type of medication. In another embodiment, one color ring 220 represents a first member of a patient's family while a second, different colored ring 220 represents a second member of the same patient's family. In one example, the color or pattern of colored ring 220 corresponds with the color code 116 (FIG. 2 and FIG. 8) to facilitate correspondence between information insert 14 and packaged medication 16 and to provide an additional check to the pharmacy worker to quickly be sure the proper packaged medication 16 is placed in bag 12 with information inset 14.

Additional uniquely colored rings 220 can represent additional types of medication or additional family members, respectively. In another embodiment, different colored rings 220 represent other parameters useful for uniquely identifying each single bottle among a plurality of bottles 200. In another embodiment, ring 220 is not mounted to bottle 200 for using color differentiation via ring 220. In another embodiment, ring 220 is removably mounted to bottle 200 but comprises a neutral color that does not differentiate between different bottles, such as the color of bottle 200, differentiate rings 220 of different family members, etc. Accordingly, ring 200 further contributes to easy-to-follow presentation of information to the patient and others. In one example, other color identifiers are used in addition to or as an alternative to differently colored rings 200 to differentiate bottles housing medications for different family members.

In one embodiment, a label 230 is applied to substantially planar surfaces of front portion 210 and rear portion 216 of bottle 200. Label 230 includes sections set off with lines and/or color shading 232. In one embodiment, the presentation of information and the use of shading 232 to correspond with medication names, etc. on label 230 presents the same general aesthetic look as information insert 14. In one embodiment, both information insert 14 and label 230 include, for example, the drug name printed over the shading 232 to effectively highlight the drug name. In this manner one comparing the information inset 14 to the label 230 of bottle 200 can quickly determine that the information insert 14 corresponds with the medication in bottle 200.

Label 230 extends over front portion 210 and/or rear portion 216. In one embodiment, a portion of label 230 extending over front portion 210 is adhesive free such that a slot 240, which is generally indicated in FIG. 1, is defined between front portion 210 and label 230. Slot 240 is sized and shaped to selectively receive information card 160 from information sheet 100 when information card 160 is folded about soft perforation lines 164. In this manner, information card 160 can laterally slide into and out of slot 240. In one instance, shaded portion 166 of information card 160 always remains outside of slot 240 to allow for easier identification of information card 160 and easier gripping of information card 160 to pull it out of slot 240.

Figure 15:
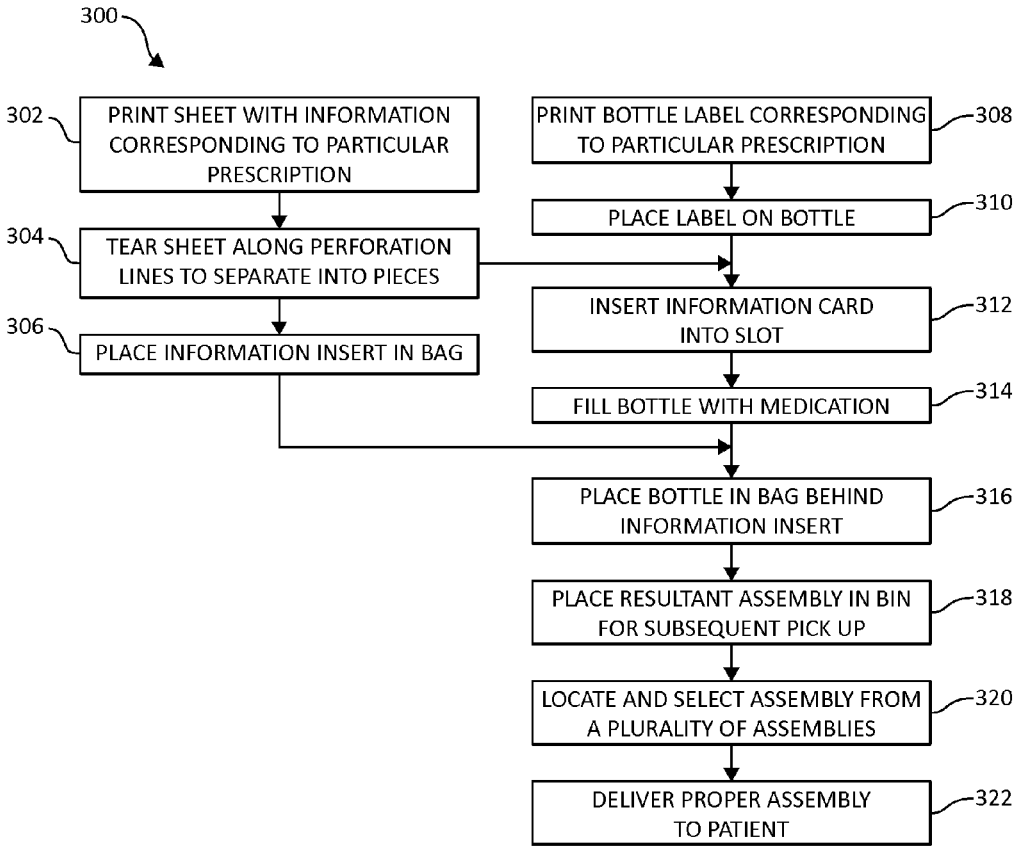
FIG. 15 is a flow chart illustrating a method of assembling and using the prescription pharmacy system, according to one embodiment of the invention.

FIG. 15 illustrates a method 300 of using medication packaging system 10 to fill a prescription or other order for medication (or a method of administering pharmaceuticals to patients), according to one embodiment of the present invention. At 302, a pharmacist or technician enters or recalls patient and prescription information into a computer control module (via a graphical user interface) and then directs printing of that information onto information sheets 100, which is loaded into or has already been loaded into the associated printer. A hardware processor then directs printing of the appropriate portions of front and back surfaces of one of the information sheets, with information relating to the particular prescription being filed in the particular sections of information sheet 100 described above (e.g., one or more of guest receipt section 104, drug information section 106, pharmacy processing section 150, compliance section 152, blank section 158, and information card 160) and/or other suitable sections.

Following printing, at 304, information sheet 304 is torn along longitudinal, hard perforation lines 102 to separate information insert 14 from a remainder of information sheet 100. Other sections, such as pharmacy processing section 150, compliance section 152, blank section 158, and information card 160 may also be separated at 304 and/or separated at a future time as the various sections are needed. In one embodiment, one or more of pharmacy processing section 150, compliance section 152, and blank section 158 may be left attached to information insert 14 and simply be folded back about longitudinal, hard perforation 102 for placement in bag 12 and easy access to those sections during processing the prescription or other medication therein for sale.

Then, at 306, information insert 14 is placed in storage chamber 36 of bag 12, more particularly, within front storage section 38 of storage chamber 36 between front panel 20 and front side panel sections 30 of side panels 26 of bag. Information insert 14 is sized to fit within bag 12 without folding or other manipulation of the overall dimensions of information insert 14, in one example. The height of information insert 14 is configured such that a bottom edge of information insert 14 is placed in bag immediately adjacent and in very near or direct contact with an internal side of bottom bag fold line 24. Substantially only patient identifying section 18 of information insert 14 extends above a top edge of front panel 20 of bag 12 as illustrated, for example, in FIG. 2. Since at least a front surface of patient identification section 18 is characterized by an absence of human readable prescription or medication identifying information as only bar code 124 of patient identifying section 18 includes prescription identifying information, this positioning of information insert 18 in bag 12 preserves the privacy of the patient from prying or wandering eyes of other patients, customers, etc. In other words, substantially all of drug information section 106 and/or the drug information 136 or other medicine identifying indicia on drug information section 106 are concealed from view by front panel 20 and rear panel 22 of bag 12.

Concurrently, before, or after steps 302, 304, and 306, at 308, label 230 of bottle 200 is printed. As for step 302, pharmacist or technician enters or recalls patient and prescription information into a computer control module (via a graphical user interface) and then directs printing of that information onto a blank label sheet (not shown), which is loaded into or has already been loaded into the associated printer. In one embodiment, the label sheet is a multiple layer sheet and configured such that individual label sections can be peeled out of the label sheet and adhered to bottle 200 via adhesive already present as part of the label sheet. A hardware processor then directs printing of the appropriate portions label 230, with information relating to the particular prescription being filled. In one embodiment, a standard black and white laser printer is used for printing at 302 while a thermal-printing is used at 308. In one example, when the pharmacist or technician enters or recalls patient and prescription information into the computer control module (via a graphical user interface) and then directs printing, information sheet 100 is automatically or can be designated to be printed substantially simultaneously with printing label 230 at 308 without requiring the pharmacist or technical to separate recall prescription information at each printing step 302 and 308.

At 310, the selected label 230 is removed from a remainder of its label sheet, and label 230 is placed on bottle 200. For example, for some bottles 200, label 230 is applied over and pressed to adhere it to each of front portion 210, spine portion 214, and rear portion 216. In one embodiment, a portion of label 230 corresponding with a portion of front portion 210 is characterized by an absence of adhesive such that slot 240 is defined between label 230 and front portion 210 with an opening thereto formed on side of label 230, e.g., near a side portion 212.

Information card 160, which was separated from a remainder of information sheet 100 at 304, is folded along soft perforation lines 164 and slid through the opening into slot 240 to be substantially maintained between label 230 and front portion 210 at 312. Once bottle 200 is properly labeled at 310 and 312, then at 314, the pharmacist or technician fills bottle 200 with the appropriate kind, dosage, and amount of medication as indicated on the patient's prescription or other drug order previously received. In other examples, bottle 200 may be filled with medication prior to labeling bottle 200 at 310 and 312. At 316, bottle 200 and all of packaged medication 16 is placed into bag 12 behind information insert 14, that is, between information insert 14 and rear panel 22 of bag 12. In this manner, insertion of packaged medication 16 does not significantly impact the amount of information insert 14 covered by front panel 20 of bag 12, which continues the integrity of the patient privacy measures achieved by packaged medication assembly 10.

At 318, packaged medication assembly 10 is placed in bin 82 or other container, file, stack, array, etc. to await pick up by the patient or her designee as illustrated, for example, in FIG. 5. In one embodiment, packaged medication assembly 10 is placed in bin 82 with other packaged medication assemblies 10 arranged in alphabetical order. In this manner, the resultant array of packaged medication assemblies 10 are presented with the respective patient identifying sections 18 extending above bags 12 for easy viewing. Notably, while one bin 82 is illustrated, it should be understood that a pharmacy will likely have many bins 82, for example, one or more for each first letter of patient last names, with the resultant array of packaged medication assemblies 10 therein all being arranged alphabetically or in some other designated order.

After time has passed since 318, at 320, the pharmacist, technician, or other pharmacy employee locates and selects one of the previously assembled packaged medication assemblies 10 that corresponds to a patient who has arrived at the pharmacy (or whose designee has arrived at the pharmacy) to pick up the packaged medication 16. In locating the desired one of the previously assembled packaged medication assemblies 10, the appropriate bin 82 is determined, and patient identifying sections 18 of the array of packaged medication assemblies 10 are viewed to determine the ones that have an partial patient identifier 114 corresponding to the patient. If more than one of the array of packaged medication assemblies 10 has the desired partial patient identifier 114, then the patient identifying sections 18 of the array of packaged medication assemblies 10 are viewed closer, for example, patient information 110 is viewed to select the one or more packaged medication assemblies 10 corresponding to the current pick up request. This method of identification is simplified as compared to prior art as the one or more packaged medication assemblies 10 being picked up can be visually identified without flipping through the array of the packaged medication assemblies 10 to verify their inclusion in the one or more packaged medication assemblies 10 being picked up. Once identified, the one or more packaged medication assemblies 10 are taken to the patient or designee and are processed for sale at the point-of-sale terminal (not shown) at 322. In one example, processing the one or more packaged medication assemblies 10 includes scanning bar code 124 at the point-of-sale terminal.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A packaged medication assembly comprising:

a bag defining a bottom bag fold line, a first panel adjacent the bottom bag fold line, a storage chamber, and an opening to the storage chamber formed at least partially by a first edge of the first panel opposite the bottom bag fold line; and an information insert having a width smaller than a width of the first panel of the bag and a height greater than a height of the first panel of the bag, wherein:

the height of the information insert is defined between a first edge of the information insert and a second edge of the information insert, the information insert includes patient information, which provides identification of a patient that a medication was packaged for, and medication information providing at least one of an identity of and a description of the medication, the information insert includes a patient identifying section including the patient information adjacent the first edge of the information insert, and a confidential medication information section below the patient identifying section that has a height less than the height of the first panel of the bag, wherein a physical perforated line separates the confidential medication section from remaining portion of the information insert including the patient identifying section, and the patient identifying section includes a computer readable code configured to identify prescription information by a computer when processing the packaged medication assembly, the information insert is placed in the storage chamber such that the second edge is positioned adjacent the bottom bag fold line and substantially only the patient identifying section of the information insert extends beyond and remains exposed above the first edge of the first panel of the bag while the confidential medication information section of the information insert remains concealed from view by the first panel of the bag so as to protect a privacy of the patient, and a packaged medication is positioned within the storage chamber behind the information insert relative to a front side of the information insert that contains the patient information.

2. The packaged medication assembly of claim 1, wherein the patient identifying section is characterized by an absence of human readable information identifying the medication.

3. The packaged medication assembly of claim 1, wherein the information insert is placed in the storage chamber such that the second edge is positioned in contact with the bottom bag fold line.

4. The packaged medication assembly of claim 1, wherein the bag defines a second panel opposite the first panel, the second panel and the first panel intersecting one another at the bottom bag fold line.

5. The packaged medication assembly of claim 4, wherein the bag defines a two side panels, the two side panels are positioned on opposing sides of the bag and each of the two side panels extends between the first panel and the second panel, each of the two side panels defines a corresponding longitudinal fold line extending from the bottom bag fold line to the opening of the bag, and each of the two side panels is folded into the storage chamber along the longitudinal fold line.

6. The packaged medication assembly of claim 5, wherein each of the two side panels is divided into a first side panel section adjacent the first panel on one side of the corresponding longitudinal fold line and a second side panel section adjacent the second panel on the other side of the corresponding longitudinal fold line, and the information insert is positioned to extend between the first panel and the first side panel section of each of the two side panels.

7. The packaged medication assembly of claim 1, wherein information insert includes a guest receipt section near the first edge of the information insert, and the guest receipt section includes the patient identifying section.

8. The packaged medication assembly of claim 7, wherein the guest receipt section includes two guest receipts separated by a perforation line.

9. The packaged medication assembly of claim 1, further comprising a pharmacy processing section bordering the information insert along a hard perforation line, the pharmacy processing section being folded about the hard perforation line when the information insert is positioned in the storage chamber of the bag.

10. The packaged medication assembly of claim 1, wherein the patient identifying section includes a partial patient identifier and a complete patient name separate from the partial patient identifier, and the partial patient identifier is visually differentiated from all other information printed on the patient identifying section.

11. The packaged medication assembly of claim 1, in combination with additional packaged medication assemblies, wherein the combination includes a bin selectively maintaining an array of packaged medication assemblies including the packaged medication assembly and the additional packaged medication assemblies such that the patient identifying section remains prominently positioned above the first panel of the bag while maintained in the array.

12. The packaged medication assembly of claim 4, wherein a first portion of the opening of the bag is formed by the first panel opposite the bottom fold line, a second portion of the opening of the bag is formed by the second panel opposite the bottom fold line, and the second portion of the opening is located further away from the bottom fold line as compared to a location of the first portion of the opening such that more of the information insert is viewable above the first panel than is viewable above the second panel.

13. A pharmaceutical preparation system comprising:

means for maintaining a drug for a patient;

means for providing human-readable information about the drug and the patient, wherein the information about the drug is spatially separated from the information about the patient; and means for containing the means for maintaining the drug and the means for providing human-readable information such that the means for maintaining the drug is substantially entirely enclosed within the means for containing, wherein the means for providing human-readable information has a height greater than a height of the means for containing and is substantially entirely enclosed within the means for containing other than a first portion of the means for providing human-readable information, and the first portion of the means for providing human-readable information includes human-readable information about the patient but is void of any human-readable information identifying the drug, and the means for providing human-readable information includes a confidential second portion, wherein a physical perforated line separates the confidential second portion from remaining portion of the means for providing the human-readable information including the first portion, and the first portion includes a computer readable code configured to identify prescription information by a computer when processing the means for providing the human-readable information, the confidential second portion of the means for providing human-readable information includes human-readable information about the drug and has a height less than the height of the means for containing and thus is concealed from view by the means for containing so as to protect a privacy of the patient when the means for maintaining the drug is positioned behind the means for providing human-readable information relative to a front side of the means for providing human-readable information that contains the human-readable information.

14. The pharmaceutical preparation system of claim 13, wherein the means for containing is a bag, and the means for providing human readable information contacts a bottom of the bag and extends from the bottom of the bag and out a top of the bag, wherein the first portion extends out the top of the bag.

15. The pharmaceutical preparation system of claim 13, wherein the means for providing human-readable information is positioned on an interior side of a panel of the means for containing, and the means for maintaining the drug is positioned on a side of the means for containing opposite the panel of the means for containing.

16. The pharmaceutical preparation system of claim 13, wherein the means for containing is a bag including a front panel and a rear panel each extending upwardly from a bottom fold line of the bag, and the means for providing human-readable information extends from the bottom fold line through the bag and out a top of the bag such that only the first portion extends above a top of the front panel of the bag.

* * * * *